United States Patent [19]

Calabrese

[11] Patent Number: 5,051,968

[45] Date of Patent: Sep. 24, 1991

[54] DIGITAL-ANALOG DISPLAY DEVICE FOR TIMEPIECE

[75] Inventor: Vincent Calabrese, Lausanne, Switzerland

[73] Assignee: Pinko S.r.l., Fidenza, Italy

[21] Appl. No.: 500,708

[22] Filed: Mar. 28, 1990

[30] Foreign Application Priority Data

Mar. 30, 1989 [EP] European Pat. Off. ..... 89810237.1

[51] Int. Cl.[5] ..... G04B 19/00; G04B 19/20

[52] U.S. Cl. ..... 368/76; 368/77; 368/221

[58] Field of Search ..... 368/76, 77, 80, 220, 368/221, 223, 228, 233

[56] References Cited

U.S. PATENT DOCUMENTS

| | | | |
|---|---|---|---|
| 555,387 | 2/1896 | Long | 368/221 |
| 577,573 | 2/1897 | Culver | 368/221 |
| 2,202,581 | 5/1940 | Hammer | 368/223 |
| 2,266,183 | 12/1941 | Fergusson | 368/77 |
| 4,659,232 | 4/1987 | Coster et al. | 368/223 |
| 4,740,934 | 4/1988 | Noirjean | 368/77 |

FOREIGN PATENT DOCUMENTS

| | | | |
|---|---|---|---|
| 625312 | 8/1927 | France | 368/233 |
| WO88/09962 | 12/1988 | PCT Int'l Appl. | 368/223 |
| 30760 | 6/1904 | Switzerland . | |
| 119761 | 4/1927 | Switzerland . | |
| 164255 | 12/1933 | Switzerland . | |

*Primary Examiner*—Vit W. Miska

*Attorney, Agent, or Firm*—Darby & Darby

[57] ABSTRACT

Digital-analog display device for timepiece comprising a cannon pinion (1), consisting of an analog disk (2) mounted on the cannon pinion and having a window (3) through which there appears a digit carried by a digital disk (5) mounted coaxially to the analog disk (2). The digital disk is driven in rotation by the cannon pinion by jumping means and its rotation relative to the analog disk is ensured by an eccentric moveable element (12) provided with a finger (13) which drives, on each revolution, a toothed wheel (6) integral with the digital disk (5).

6 Claims, 1 Drawing Sheet

DIGITAL-ANALOG DISPLAY DEVICE FOR TIMEPIECE

FIELD OF THE INVENTION

The present invention relates to a digital-analog display device for timepiece comprising a cannon pinion, consisting of an analog disk mounted on the cannon pinion and having a window through which there appears a digit carried by a digital disk, and comprising means for ensuring the rotation of the digital disk relative to the analog disk on each revolution of the analog disk.

PRIOR ART

Such a display device is known from the document CH-A-119,761. The position of the window displays the minutes in analog manner, whereas the hour is displayed digitally in the window. In this embodiment, the hour disk consists of a disk satellite-mounted on the minute disk. The diameter of the hour disk is therefore less than half the diameter of the minute disk and the hour digits are consequently relatively small, less than 1/24 of the surface of the dial being used for displaying the hour. Although the size of the hour digit may still be sufficient for a pocket watch, it becomes, however, totally insufficient for a wristwatch. The document CH-A-30,760 describes a similar construction with the exception that the minute disk consists here of a minute indicator in the form of a vane, at the center of which the hour disk is mounted. This device therefore has the same disadvantages as the previous device.

The object of the present invention is to ensure that the hour can be read easily, in the case of a wristwatch too.

SUMMARY OF THE INVENTION

The digital-analog display device according to the invention is defined in that the digital disk consists of a disk coaxial to the analog disk and driven in rotation by the cannon pinion by jumping means, and in that the means for ensuring the rotation of the digital disk relative to the analog disk consist of an eccentric moveable element which ensures, on each revolution, the displacement of the digital disk relative to the analog disk.

The analog disk will generally, but not necessarily, be a minute disk whereas the digital disk will be an hour disk.

Particularly advantageous embodiments of the invention are defined by the dependent claims 2 to 4. The displacement of the digital disk is ensured by a finger revolving in the opposite direction to the digital disk, the effect of which is to ensure a very rapid change of the displayed digit with a minimum disturbance to the operation of the watch.

BRIEF DESCRIPTION OF THE DRAWING

The accompanying drawing shows, by way of example, one embodiment of the invention.

DESCRIPTION OF THE PREFERRED EMBODIMENT

Figure 1:
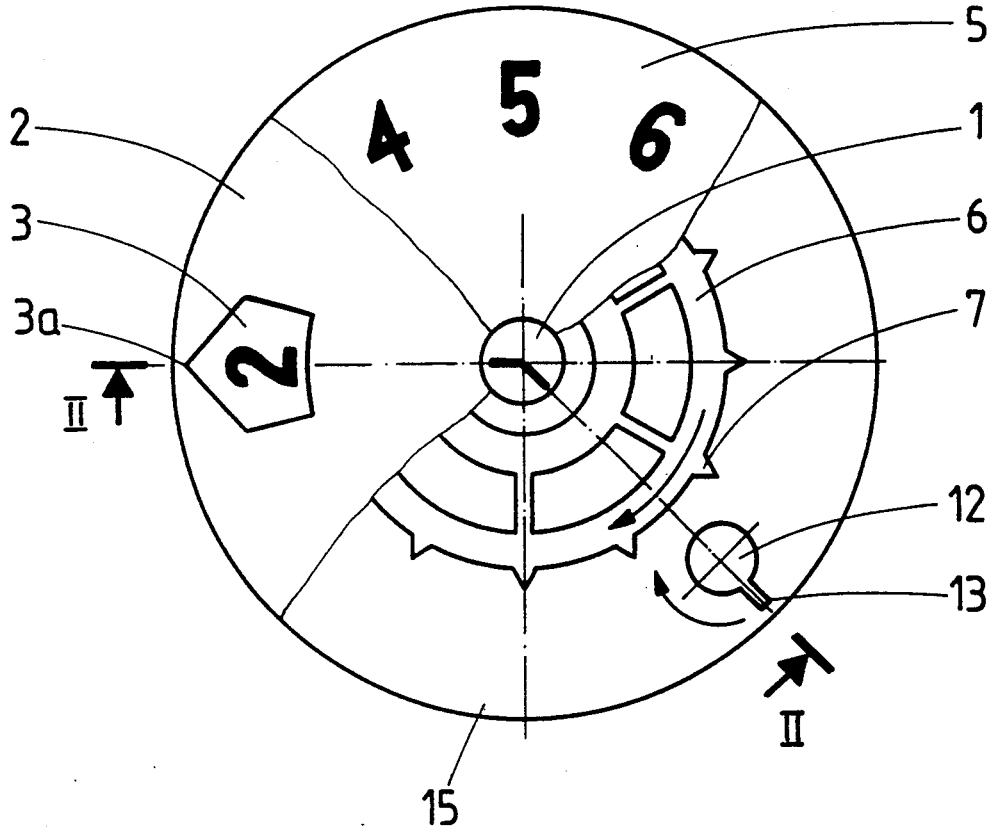
FIG. 1 is a plan view of the display device.
Figure 2:
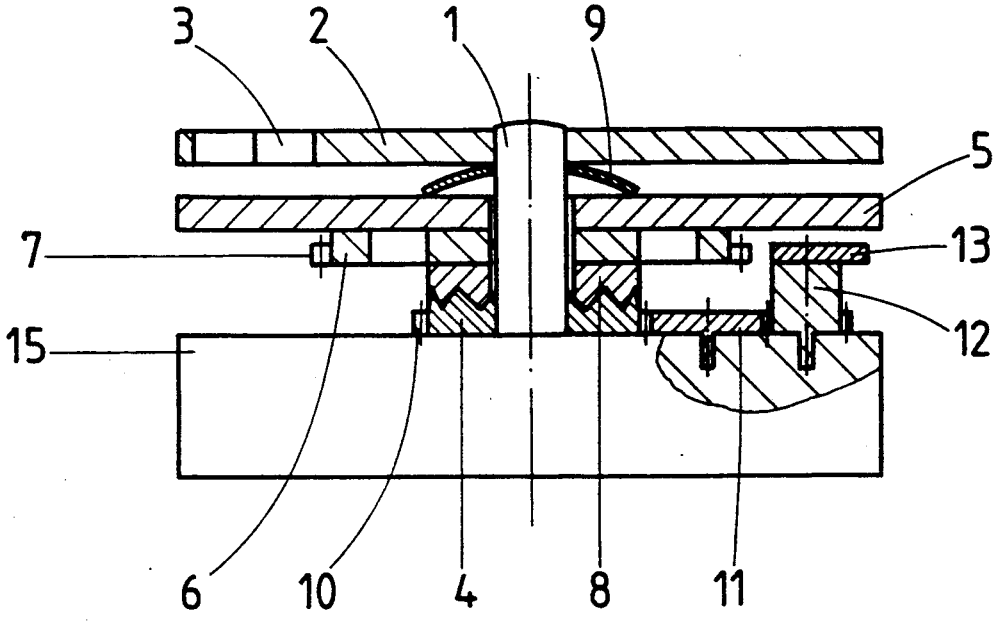
FIG. 2 is a sectional view along II—II of FIG. 1.

The drawing shows diagrammatically a timepiece movement 15, provided with a cannon pinion 1 on which there is moveably mounted a minute disk 2 provided with a window 3, the outline of which has a point

3*a* which acts as the minute indicator for the analog display of the minutes. A pinion 4 having an edgewise triangular toothing of twelve teeth is additionally riveted on the cannon pinion 1. The cannon pinion additionally carries an hour disk 5, of the same diameter as the minute disk 2 and carrying the hour digits which appear in the window 3 one after the other. The hour disk 5 is rotatably mounted on the cannon pinion 1. It is integral with a wheel 6 provided with twelve teeth 7 and with a pinion 8 having edgewise toothing similar to the pinion 4 and meshing with this pinion 4 under the pressure of a spring 9 mounted between the minute disk 2 and the hour disk 5. The hour disk 5, the toothed wheel 6 and the pinion 8 therefore constitute a monobloc assembly which could consist of a single piece. The pinion 4 is provided with a peripheral toothing 10 meshing with a counter gear 11 mounted on the bottom plate of the movement and driving a pinion 12 mounted eccentrically on the bottom plate and provided with a finger 13. The pinion 12 therefore revolves at the same speed as the minute disk 2 and the hour disk 5, but in the opposite direction to these disks. The spring 9 and the pinion 8 constitute a jumping device.

The display device operates as follows: the hour disk 5 is driven in rotation synchronously with the minute disk 2 so that, during the rotation of the minute disk 2, the hour digit remains displayed in the window 3. Once every hour the finger 13 of the pinion 12 abuts against one of the teeth 7 of the wheel 6. Since the pinion 8 is prevented from revolving, it moves away from the pinion 4 while compressing the spring 9 and its teeth mount onto the teeth of the pinion 4. Since the wheel 6 is displaced axially with the hour wheel 5, its tooth 7 in engagement with the finger 13 finally escapes from the finger 13, but not before the teeth of the pinion 8 have passed over the teeth of the pinion 4. The teeth of the pinion 8 then re-engage in the teeth of the pinion 4 under the pressure of the spring 9, and the hour disk 5 is again positioned relative to the minute disk 2 with a displacement of 30° causing the next hour digit to appear in the window 3.

An important advantage of the construction described above lies in the fact that the finger 13, having a small radius, actuates the wheel 6 on its periphery and while revolving in the opposite direction to this wheel. In view of the small diameter of the pinions 4 and 8, an almost instantaneous jump of the hour disk is obtained without substantially disturbing the operation of the watch as a result of an overload.

The jumping mechanism consisting of the spring 9 and the pinion 8 could, of course, be replaced by any other jumping mechanism, for example by a jumping spring mounted on the hour wheel 5 and cooperating with a star wheel fixed on the cannon pinion 1. This construction makes it possible to eliminate the spring 9 and to reduce the height of the cannon pinion.

The number of teeth of the pinions 4 and 8 and of the wheel 6 may, of course, differ from 12 in order to obtain a 24-hour display or divisions other than hourly divisions.

I claim:

1. A digital-analog display device for timepieces, comprising:

a rotatable cannon pinion;

means for rotating said cannon pinion;

an analog disk attached to said cannon pinion, said analog disk having a window:

a rotatable digital disk located adjacent to said analog disk;

at least one digit located on said digital disk;

means for rotating said digital disk relative to said analog disk, said rotating means being responsive at a predetermined point of each revolution of said analog disk, said rotating means including a toothed wheel coaxially attached to said digital disk and a moveable eccentric element which is located at a point adjacent to said toothed wheel;

means for moving said eccentric element so that said toothed wheel rotates said digital disk at said predetermined point; and means for selectively aligning said at least one digit of said digital disk with respect to said window in response to said rotation of said digital disk relative to said analog disk.

2. The display device as claimed in claim 1, wherein said selective aligning means further includes a first face gear attached to said digital disk and being coaxial with said cannon pinion, and a second face gear attached to said cannon pinion and arranged so that said teeth of said first and said second face gears selectively mesh, said meshing of said face gears aligning said at least one digit with said window.

3. The display device as claimed in claim 2 wherein said selective aligning means further includes means for biasing said teeth of said first face gear into selective engagement with said teeth of said second face gear, said face gears disengaging in response to said rotation of said digital disk with respect to said analog disk at said predetermined point.

4. The display device as claimed in claim 1 wherein said toothed wheel is integral with said digital disk.

5. The display device as claimed in claim 1 wherein said toothed wheel and said first face gear are integral with said digital disk.

6. The display device as claimed in claim 1 wherein said eccentric element counter-rotates at the same rate of rotation as said analog disk, said eccentric element includes a finger which, at said predetermined point, abuts against one of said teeth of said toothed wheel and causes said rotation of said digital disk with respect to said analog disk, thereby ensuring a very rapid change of said at least one digit with respect to said window.

* * * * *